United States Patent [19]

Taub

[11] 4,085,986

[45] Apr. 25, 1978

[54] AUXILIARY REFRIGERATED DISPLAY CASE

[75] Inventor: Ronald H. Taub, Highland Park, Ill.

[73] Assignee: Taub Family Trust U/A Sept. 1, 1967, Chicago, Ill.

[21] Appl. No.: 725,644

[22] Filed: Sep. 22, 1976

[51] Int. Cl.[2] ..... A47B 77/08; A47F 3/04; A47B 81/00

[52] U.S. Cl. ..... 312/236; 312/209; 312/214; 62/255

[58] Field of Search ..... 312/236, 209; 62/255, 62/256

[56] References Cited

U.S. PATENT DOCUMENTS

| | | | |
|---|---|---|---|
| 1,434,544 | 11/1922 | Jensen | 62/255 |
| 2,262,104 | 11/1941 | Lambrecht et al. | 312/236 |
| 2,263,862 | 11/1941 | Usmar | 312/236 |
| 2,421,314 | 5/1947 | Brinkoeter | 62/256 |
| 2,466,286 | 4/1949 | Stultz | 62/255 |
| 3,172,714 | 3/1965 | Kesling | 312/236 |
| 3,319,557 | 5/1967 | Perez | 62/256 |
| 3,548,610 | 12/1970 | Kendall et al. | 62/256 |
| 3,552,138 | 1/1971 | Davis | 62/256 |

*Primary Examiner*—Paul R. Gilliam
*Assistant Examiner*—Victor N. Sakran
*Attorney, Agent, or Firm*—Michael G. Berkman; Glenn E. Klepac

[57] ABSTRACT

An open-top, thermally insulated "secondary" case for the storage and display of perishable food stuffs which must be maintained at a refrigerated temperature. The case is "parasitic" in the sense that it itself includes no independent refrigeration apparatus but is, rather, supported on a wall of a primary or "host" refrigerated storage and display case so that, with the aid of a cooperating fixed baffle, air deflection panel, or vane, cooled air from the primary storage case is directed into the secondary case, thereby to cool the interior of the secondary case and the articles retained therein.

5 Claims, 4 Drawing Figures

AUXILIARY REFRIGERATED DISPLAY CASE

BACKGROUND OF THE INVENTION

The present invention relates to an insulated, open-top case for the display and storage of food stuffs and similar articles which must be maintained at a cool temperature. More particularly, the invention is directed to a novel cooler, cabinet or display case which does not have its own, independent mechanical refrigerator system. Rather, the cabinet of the invention functions as a "slave" unit or a "parasite" which derives its cold-producing medium (cold air) from a primary or "host" refrigerated display case.

It is an important feature of the invention that the novel "parasitic" case functions in conjunction with a cooperating air flow directing panel or vane so that cold air from the primary refrigerated case is directed into the case of the invention to cool the interior thereof and articles retained therein.

It will be appreciated by those skilled in the relevant art that perishable food stuffs of the type stored at reduced temperatures in order to prolong their useful shelf life, may be classified into two general groups. The first group must be kept hard-frozen, preferably at a temperature well below the freezing point of water. The second group of such perishable food stuffs can be stored safely if maintained at a temperature in the range of about 45° F or below. Typical of this latter catagory of comestibles are cheese products, dairy products in general, and dough products including packaged or canned dough products. It will be understood that important savings of expensive-to-maintain space in refrigerated display containers may be effected if products which do not require the zero or sub-zero Farenheit temperature can be stored conveniently at a higher, but still functionally effective, refrigerating temperature.

It is an important discovery of the present invention that it is possible to direct cold air, normally lost by convection from open-top refrigerated display cases of the type used in supermarkets or the like, to flow into an auxiliary, secondary display case which is closely associated, physically with the principal, primary case whereby a significant fraction of the cold air ordinarily lost from the display case enters the auxiliary case to effect significant cooling of the contents thereof.

An important related practical feature of the invention is that the cooling of the auxiliary or "parasitic" storage case is effected without any adverse effect upon the operation of the primary, refrigerated case.

Still another important feature of the invention is that the secondary case is effectively cooled without the use of conventional cooling apparatus and without the use of any auxiliary fans or similar air moving devices.

In the preferred embodiment of the invention, the cold air emanating from the refrigerated case is directed to flow downwardly into the secondary case of the invention through the expedient of a baffle or vane. This vane is so oriented in space as to function effectively somewhat as a reflector so that the cold air circulating above the refrigerated case is directed or guided to invade and permeate the chamber of the secondary display case of the invention.

BRIEF DESCRIPTION OF THE DRAWINGS

Other and further objects features, and advantages of the invention will become apparent from a consideration of the following specification and the drawings in which.

DETAILED DESCRIPTION OF A PREFERRED EMBODIMENT

Figure 2:
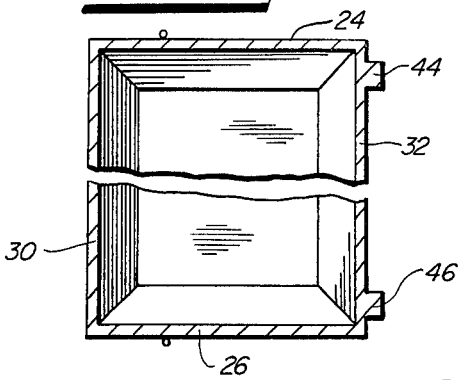
FIG. 2 is a cross sectional view taken substantially on the lines 2—2 of FIG. 1.

In accordance with the present invention, the aims and objects are accomplished by providing a secondary open-top case, means for securing the case on to be supported by a forward wall of a primary, refrigerated case, and an air deflection vane which serves to direct cold air emananating from the refrigerated case into the secondary case of the invention, thereby to cool the interior of the case and the contents thereof.

For purposes of disclosure, the invention is shown and described with reference to a preferred embodiment. It is apparent, however, that the invention is susceptible of various modifications and alternative constructions and it is intended, therefore, that the invention cover all such modifications and alternative constructions falling within the scope of the appended claims.

Referring now to the drawings, in the form of the invention illustrated, the case or cabinet is shown as embodying an open-top container 20 fabricated of heat insulating material such as rigid polystyrene foam sheeting. The case or cabinet 20 is preferably rectangular in horizontal cross section and, as depicted, is formed with a pair of opposed vertical end walls 24 and 26, front and rear walls 30 and 32, and a floor 36. The front and rear walls 30 and 32 are preferably angled or sloped inwardly from top to bottom so as to provide enhanced aerodynamic flow characteristics.

Extending rearwardly of and horizontally along the display case 20 near the top of the rear wall 32 is a horizontally extending support flange 40. A pair of vertically extending struts 44 and 46 attached to the backside of the rear wall 32 bear upon the front face 50 of a refrigerated display case 60 as the support flange 44 bears upon the upper edge 64 of the front wall 66 of the refrigerated case 60 so as to maintain the secondary case 20 in its proper and desired operational attitude. Conveniently, the case 20 may be molded as an integral unitary structure.

In the particular embodiment of the invention shown, a metal frame or cradle 70 serves to carry the weight of the cabinet 20, and its contents. The frame 70 consists of an upwardly opening U-shaped sling-like bar 74 which loops beneath and engages the bottom 36 and the opposed sides 24 and 26 of the case 20, and a horizontally extending U-shaped band opening rearwardly and engaging the case 20 at the front wall 30 and at its opposed side walls 24 and 26. The horizontal U-band and the vertical sling are joined to one another by welds at cross-over points 90.

Figure 1:
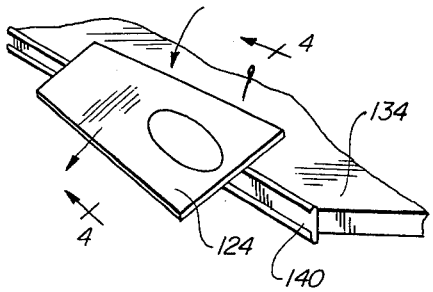
FIG. 1 is a diagramatic perspective view illustrating the display case of the invention supported on a primary refrigerated case and also suggesting, schematically the manner in which the cold air emanating from the refrigerated case is directed into the auxiliary, "parasite" case of the invention.
Figure 1:
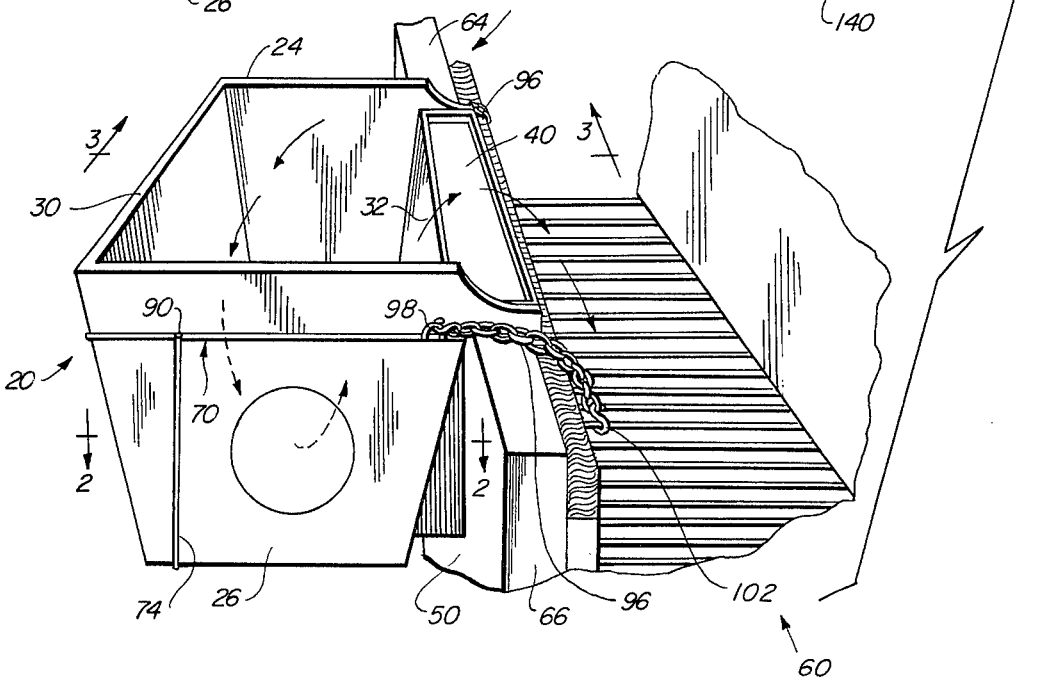
Figure 3:
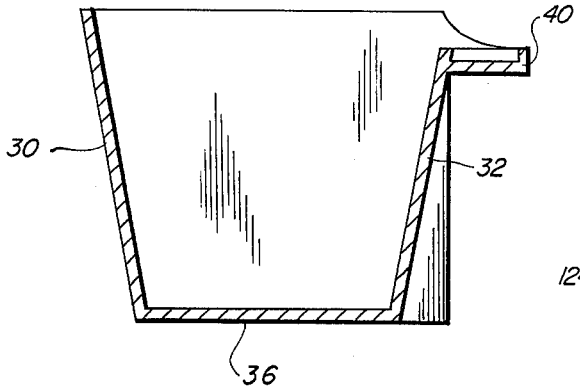
FIG. 3 is a cross sectional view taken substantially on the lines 3—3 of FIG. 1.

A pair of short chains 96 terminating in S-hooks are attached at one end to a corresponding pair of side loops 98 fastened to the wire frame 70. With the chains 96 trained over the front wall 66 of the refrigerated case 60, the opposite ends 102 of the chains 96 are secured to the refrigerator case by attachment to the usual grill or grating 110 as shown in FIG. 1. When so secured, the "parasite" case 20 should preferably be angled slightly upwardly from rear to front so that it will assume a level position when loaded with product.

An air-directing and deflecting vane or panel assembly 120 completes the apparatus. As shown, in its shelf-mounted position shown in FIG. 1, the panel or vane assembly 120 consists of a vane 124 and an attachment mechanism 130. The vane 124 is preferably an elongated rectangle in form with a width substantially equal to the width or lateral expanse of the case of the invention. Functionally the role of the vane is to direct the cold air which evolves from the refrigerated case 60 through convection downwardly into the dependent case 20, as indicated schematically in FIG. 1. Any preferred technique may be utilized to secure the vane in the desired position and at the required angle, of about 45 degrees. In the particular example of the invention illustrated, the vane 124 is conveniently secured to a product shelf 134 customarily located above the refrigerated case 60. Such product carrying shelves 134 are ordinarily provided with a price indicating or product identifying rail 136 generally C-shaped in vertical section and secured along a flattened rear face 138 to the front edge 140 of the shelf 134.

A generally U-shaped clamp element 144 terminating in a pair of outwardly directed or diverging legs 146 and 148 is positioned so that the legs enter into and engage within the upper and lower opposed curved sections 152 and 154 of the price rail 140. A screw 160 threaded through one leg 148 of the U-clamp 144 and bearing against the opposite leg 146 urges the legs apart to lock within the price rail 136 so as to effect a securement of the clamp 144 to the shelf 134.

Figure 4:
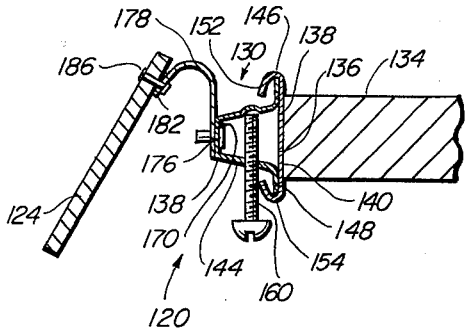
FIG. 4 is a cross sectional view taken substantially on the lines 4—4 of FIG. 1 and showing the manner in which the air deflecting vane is secured to a product storage shelf located above the refrigerated display case.

At its flattened face 170 of the clamp 144 and generally paralleling the edge 140 of the shelf 134 there is bolted 176 or otherwise secured a curved metal strap 178 the free end 182 of which assumes an angle desired for the deflection vane 124. The vane itself is attached to the strap 178 by means of a nut and bolt assembly 186, as clearly indicated in FIG. 4.

The air flow directing vane 124, attached as described and illustrated functions effectively to deflect cold air from the refrigerated case 60 into the display unit 20 of the invention whereupon air from the display unit then travels upwardly along the back wall 32 and recirculates through the refrigerated case 60, thus ensuring a continual flow of cooling air into the display case 20.

What is claimed is:

1. In the combination of an open top refrigerated display case constituting a primary case having a front wall and including refrigeration means for maintaining the interior of the primary case at a reduced temperature to promote safe storage of heat-sensitive items contained therein, with a secondary display case physically distinct from the primary case and positioned exteriorly thereto adjacent a front face of said front wall, said secondary case including a floor, a pair of opposed end walls, and front and rear walls defining an upwardly open chamber for storage and display of articles disposed therewithin at a reduced temperature, said secondary case being devoid of independent refrigeration means and there being no auxiliary air pump means or duct means associated with said secondary case; the improvement wherein said primary case further comprises air deflection means in a flow path of cool air emanating from the primary case for directing transfer of cool air from the interior of the primary case to the chamber of the secondary case, said air deflection means comprising a laterally-elongated, panel-like vane comprising a fixed attachment to said primary case, and means supporting said vane at a position above said secondary case and in proximity thereto, wherein said vane is supported by a shelf extending laterally in a zone generally above said primary display case and rearwardly of and in line with said secondary case, and said vane is angled to project upwardly and rearwardly with respect to said secondary case.

2. The improvement of claim 1, wherein said vane is tilted at an angle of about 45° with respect to said secondary case.

3. The improvement of claim 1, and further comprising attachment means for securing said secondary case to said primary case, said attachment means comprising frame means adapted to cradle said secondary case therewithin for support thereof, and conformable and adjustable coupling means and means for attaching said coupling means to said frame means and to said primary case as mechanical linkages therebetween, to support said secondary case on said primary case.

4. The improvement of claim 3 wherein said coupling means securing said frame means to said primary case is disposed to bridge and bear upon a top edge of a front wall of said primary case, whereby said frame means and secondary case supported therein are carried by and hang from said primary case in stressed contact with a vertical front face of said front wall of said primary case.

5. The improvement of claim 1, wherein said front wall and said pair of opposed end walls of the secondary case extend upwardly above an upper edge portion of said rear wall.

* * * * *